US008051684B2

(12) United States Patent
Keitch

(10) Patent No.: US 8,051,684 B2
(45) Date of Patent: Nov. 8, 2011

(54) KNITTED TULLE

(75) Inventor: George Keitch, Shoreditch (GB)

(73) Assignee: Heathcoat Fabrics Limited, Tiverton, Devon (GB)

( * ) Notice: Subject to any disclaimer, the term of this patent is extended or adjusted under 35 U.S.C. 154(b) by 0 days.

(21) Appl. No.: 12/733,962

(22) PCT Filed: Sep. 26, 2008

(86) PCT No.: PCT/GB2008/050869

§ 371 (c)(1), (2), (4) Date: Mar. 31, 2010

(87) PCT Pub. No.: WO2009/044185

PCT Pub. Date: Apr. 9, 2009

(65) Prior Publication Data

US 2010/0229605 A1 Sep. 16, 2010

(30) Foreign Application Priority Data

Oct. 3, 2007 (GB) ..... 0719225.5

(51) Int. Cl.
*D04B 23/06* (2006.01)

(52) U.S. Cl. ..... 66/193; 66/195

(58) Field of Classification Search ..... 66/190, 66/191, 192, 193, 195
See application file for complete search history.

(56) References Cited

U.S. PATENT DOCUMENTS

| | | | | | |
|---|---|---|---|---|---|
| 2,691,286 | A | * | 10/1954 | Cooper | 66/192 |
| 3,084,529 | A | * | 4/1963 | Scheibe | 66/193 |
| 3,106,079 | A | * | 10/1963 | Kohl | 66/193 |
| 3,308,827 | A | * | 3/1967 | Gross | 604/384 |
| 4,074,543 | A | * | 2/1978 | Schmidt | 66/193 |
| 4,563,382 | A | | 1/1986 | Viel | |
| 4,748,078 | A | * | 5/1988 | Doi et al. | 442/312 |
| 5,265,445 | A | * | 11/1993 | Shytles et al. | 66/192 |
| 5,732,573 | A | | 3/1998 | Sexton | |
| 6,041,624 | A | * | 3/2000 | Pederzini | 66/193 |
| 6,314,768 | B2 | * | 11/2001 | Motoya | 66/85 R |
| 6,848,281 | B2 | * | 2/2005 | Ishihara et al. | 66/195 |
| 7,269,978 | B2 | | 9/2007 | Amigo | |
| 2003/0211798 | A1 | * | 11/2003 | Ishihara et al. | 442/304 |
| 2010/0229605 | A1 | * | 9/2010 | Keitch | 66/195 |

FOREIGN PATENT DOCUMENTS

| | | | |
|---|---|---|---|
| EP | 0 137 091 | A2 | 4/1985 |
| EP | 1 106 722 | A1 | 6/2001 |
| EP | 1 736 583 | A1 | 12/2006 |
| FR | 1 287 973 | A | 3/1962 |
| GB | 919 295 | A | 2/1963 |
| GB | 1 230 232 | A | 4/1971 |
| GB | 1 275 448 | A | 5/1972 |
| GB | 2 325 674 | A | 12/1998 |
| KR | 10 2004 0085083 | A | 10/2004 |
| SU | 1837084 | A1 | 8/1993 |

* cited by examiner

*Primary Examiner* — Danny Worrell

(74) *Attorney, Agent, or Firm* — Marshall & Melhorn, LLC

(57) ABSTRACT

A knitted tulle is disclosed, the tulle comprising a plurality of wales, each with a pillar stitch and at least two pairs of weft threads, each pair of weft threads interconnecting and tying-in at least four wales. Also disclosed is a method of knitting the tulle, preferably using a Raschel machine and an embroidered fabric comprising the tulle. The tulle according to the invention is robust and even and has properties similar to bobbinet tulle.

20 Claims, 5 Drawing Sheets

KNITTED TULLE

BACKGROUND OF THE INVENTION

The present invention relates to knitted tulles and methods of knitting tulles.

Tulle is a type of fine netting which has applications in embroidery, lingerie, bridal wear and haute couture as well as in technical areas where the durability and flexibility of netting are of particular importance. Such technical applications include military (e.g. radar reflective netting and parachute netting) and medical applications and as light diffusion fabrics in film and theatre applications.

Bobbinet tulle is a particular type of tulle which was first produced in the early $19^{th}$ Century following the invention of the bobbinet machine in 1806 by John Heathcoat. The structure of bobbinet tulle provides advantageous properties of uniformity, strength and flexibility. One particularly advantageous property of bobbinet tulle in relation to embroidery is that it is flexible at the scale of the holes in the net structure which reduces the likelihood of yarn breakage when an embroidery needle (especially in machine embroidery) passes through the hole.

Unfortunately, the production of bobbinet tulle, which still uses the mechanisms devised by John Heathcoat, is slow. Bobbinet tulle is thus expensive and so is not, in practice, used in applications where its properties would otherwise make it suitable.

There have been attempts to devise faster production methods for nets or openwork fabrics using knitting machines, in particular, warp knitting machines. GB-A-1,275,448 relates to a method of producing patterned net fabrics on a Raschel warp knitting machine. GB-A-2,325,674 relates to an openwork knitted fabric that has a high capacity for absorption of size and so can be made harder and stiffer than previous fabrics.

There have also been attempts to produce knitted tulles or tulle-like materials. GB-A-1,230,232 relates to tulle having hexagonal openings produced on a Raschel knitting machine.

Unfortunately, the tulle described in GB-A-1,230,232 has a pattern which is very sensitive to differences in tension in the inlay threads. Unless the tension in each inlay thread is the same, the tulle is extremely distorted. It is, in practise, very difficult to control the tension of the inlay threads to the required degree because even a relatively narrow warp knitting machine may have over 5,000 separate inlay threads.

SUMMARY OF THE INVENTION

The present invention aims to provide a knitted tulle having the advantages of bobbinet tulle but avoiding or alleviating the problems of the prior art.

The present invention accordingly provides, in a first aspect, a knitted tulle comprising a plurality of wales each wale preferably having a pillar stitch (i.e. overlap) and at least two pairs of weft threads, wherein each pair of weft threads interconnects and ties-in (i.e. underlaps) at least four wales.

Preferably, each pair of weft threads interconnects and ties-in four wales only. Each pair of weft threads may interconnect and tie-in more wales than this (for example 5, 6, or more), however, the more wales which are interconnected and tied-in, the more complicated the tulle and, generally, the greater the repeat length.

Preferably, the tulle is flat (i.e. not a tube).

Preferably, the pattern is such that four or more inlay threads inlay on each wale. This is advantageous because it adds robustness, stability and strength to the pattern.

The interconnection and tying-in of at least four wales is greatly advantageous in that any differences in tension between the individual weft threads are spread more evenly across the tulle as a whole providing regularity, evenness, strength and flexibility. In particular, the holes of the tulle fabric are more regular in size which results in a stronger and more robust product and is visually more appealing in the marketplace.

Preferably, each weft thread of each pair interconnects and ties-in (i.e. crosses over between) at least three (preferably adjacent) wales. Each weft thread may interconnect and tie-in more wales than three, but this significantly increases the complexity of the pattern and the repeat length.

The interconnection and tying-in of at least three wales by each weft thread is advantageous because it also results in differences in tension being spread more evenly across the tulle as a whole, contributing to the regularity, evenness, flexibility and strength of the tulle.

Preferably, each weft thread of each pair follows a pattern which is the mirror image of the other weft thread in the pair; the mirror plane being substantially parallel to the wales.

Preferably, each pair of weft threads follows the same basic pattern, with respective pairs following patterns that may be shifted (i.e. offset or out-of phase) by a predetermined number of courses with respect to the pattern of another (or patterns of other) pair(s). In addition, or alternatively, respective pairs may follow patterns that are inverted with respect to the pattern of another (or patterns of other) pair(s). Such an inversion may be across a plane substantially perpendicular to the wales (and possibly parallel to the courses).

A first pair of weft threads which shares a wale with a second pair of weft threads, may follow a pattern which is out-of-phase with the pattern of the second pair by a predetermined number of courses.

Generally, the repeat length of the pattern will be a multiple of the predetermined number of courses to ensure that the pattern is regular. Preferably, the predetermined number of courses is a quarter of the repeat length, although it may be a half, third, fifth or sixth.

The predetermined number of courses may be 1 to 24, preferably 4 to 18, or 4 to 12, most preferably 6. The out-of-phase shift is advantageous because it improves the appearance and evenness of the tulle.

The first pair of weft threads may additionally, or alternatively, describe a pattern which is an inversion of the pattern of the second pair. Thus, preferably a first pair of weft threads which shares a wale with a second pair of weft threads follows a pattern which is an inversion of the pattern of the second pair.

The relationship of the pattern of each weft thread in the pair and of (e.g. immediately) neighbouring pairs of weft threads result in a regular overall pattern in the tulle leading to advantages in strength and robustness of the product.

Preferably, the tulle has substantially hexagonal holes. It is also advantageous if the tulle is substantially regular in either weft direction, the warp direction, or preferably both.

Usually, the pattern described by each pair of weft threads has a repeat of 12 to 60 courses. More preferably, the pattern followed by each pair of weft threads has a repeat of 12 to 48, 12 to 36, most preferably, of 20 to 30 courses. The preferred embodiment has a repeat of 24 courses.

Preferably, the pattern of each pair of weft threads includes at least two cross overs (i.e. two points at which the threads of the pair cross over each other).

In the most preferred embodiment of the invention, each weft thread of the first pair crosses to the corresponding wale of the other weft thread over three courses to form a first cross between the two wales, each weft thread of the pair then making six inlays in opposite directions on their respective wales, each weft thread of the pair then crossing over to a wale distal to the wale of the other weft thread in three courses over two wales, each weft thread then making three inlays in opposite directions in three courses, each weft thread then crossing over to its previously occupied wale in three inlays over three courses, crossing over to the corresponding wale of the other weft thread in three inlays over three courses to form a second cross between the two wales and each weft thread then making three inlays over three courses in opposite directions.

Preferably, the second pair of weft threads follows a pattern which is the inverse of, and/or is out-of-phase by a predetermined number of courses with, the pattern followed the first pair.

The tulle according to the first aspect of the invention may comprise synthetic or natural yarn. Examples of yarn which may be used to produce the tulle may be selected from polyester, polyamide (e.g. 6 or 66), polyaramid (meta and/or para), cotton, wool, hemp, silk and/or a mixture of one or more of these yarns. Generally any yarn which may be used in the textile industry would be suitable, depending on the intended application, however, preferred yarns are silk, cotton, polyester or nylon (i.e. polyamide).

The yarn count is preferably from 17 decitex to 280 decitex but may be greater or lesser than this for certain, specific applications.

Generally, the hole count of the tulle according to the first aspect of the invention will be between 14 and 128 holes per inch (5 to 51 holes per cm).

One of the great advantages of the tulle according to the present invention is that it is flexible, especially at the scale of the holes in the fabric. This is particularly advantageous for tulle used in embroidery because the flexibility of the threads defining each hole means that there is significantly less chance of yarn breakage when an embroidery needle passes through the hole. The applicant has surprisingly discovered that, as in bobbinet tulle, the threads defining the hole are flexible enough to move aside to allow the passage of an embroidery needle even if it is not precisely directed through the centre of the hole.

The tulle according to the present invention has a further advantage in that the fabric as a whole is flexible and resilient.

As discussed above, the knitted tulle according to the first aspect of the invention is produced by a knitting process. The present invention, accordingly provides, in a second aspect, a method of knitting a tulle, the method comprising forming a plurality of wales, and interconnecting at least some wales with at least two pairs of weft threads, wherein the method is such that each pair of weft threads interconnects and ties-in at least four wales.

The preferred method of knitting is warp knitting. Warp knitting is preferably performed using a Raschel knitting machine.

In the preferred embodiment of the invention, the Raschel knitting machine has 5 or more guide bars (e.g. 5, 6, 7, 8, or more guide bars). One guide bar is required in order to form the stitches, the remaining 4 guide bars are used to generate the inlays of two pairs of weft threads which define the tulle holes.

Preferably the machine gauge of the machine used to knit the tulle is 20 needles per inch to 50 needles per inch (8 needles per cm to 20 needles per cm).

Preferably, the machine is a single needle bed machine to produce a flat (i.e. not a tube) fabric.

Other preferred and optional features of the method of the second aspect of the invention are generally as described in relation to the first aspect, with appropriate modification.

Tulle produced according to the invention finds uses in technical fabrics, embroidery, automotive applications, theatrical, film, military and apparel dress and headwear applications. One particularly important use of the tulle according to the present invention is embroidery both because of the advantages it shares with traditional bobbinet tulle but also because it can be made at a much faster rate and is, therefore, more cost effective.

Thus, in a third aspect of the present invention, the present invention provides an embroidered fabric comprising a tulle according to the first aspect of the invention. The present invention also provides a product comprising a tulle as described in relation to the first aspect of the invention.

In a fourth aspect of the present invention, there is provided a knitted tulle comprising a plurality of wales and a plurality of weft threads, wherein each weft threads interconnects and ties-in at least three wales.

BRIEF DESCRIPTION OF THE DRAWINGS

By way of example, an embodiment of the present invention will now be described with reference to the accompanying drawings, in which.

DETAILED DESCRIPTION OF THE INVENTION

Figure 1:
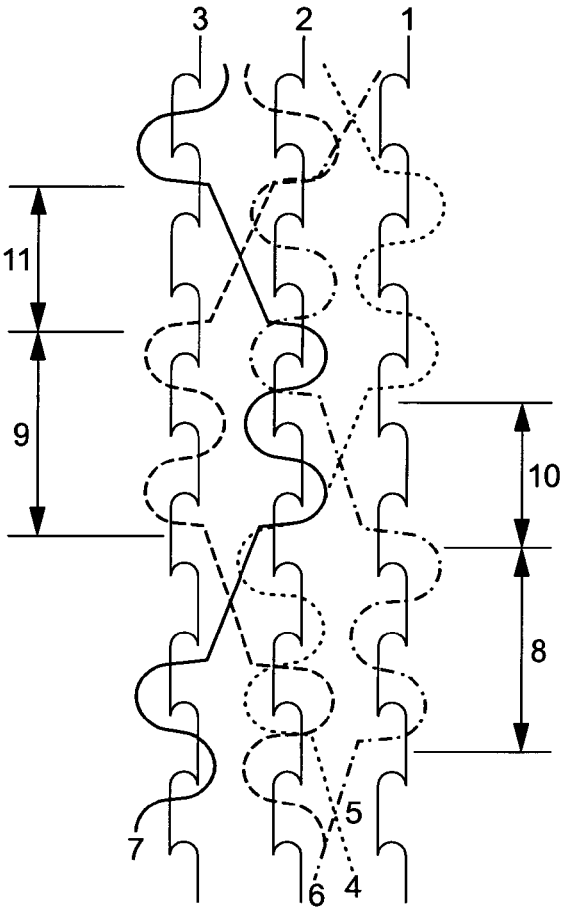
FIG.1 PRIOR ART
FIG. 1 illustrates a prior art pattern of a knitted cross-tulle as disclosed in GB-A-1230232.

A prior art pattern, illustrated, in FIG. 1, is of a knitted cross-tulle consisting of single-needle wales 1, 2 and 3 which are formed singly and are interlaced only by weft threads. Weft threads 4, 5, 6 and 7 are shown. The weft threads 4 and 5 form one pair and the weft threads 6 and 7 another pair.

The weft threads 4 and 5, and 6 and 7, make three laps into the wales in three courses. Two of these adjoining runs of three laps are indicated by numerals 8 and 9. The weft threads then form a cross 10 and 11, respectively, between the wales 1 and 2, and between the wales 2 and 3, over three courses (described as two courses in the document but more properly considered as three). The weft threads 4 and 5 then effect, in the wales 1 and 2, and the weft threads 6 and 7 effect, in the wales 2 and 3, the three laps 8 and 9 respectively, whereupon they return to their initial wales by crossing over three courses.

The fabric produced using the pattern of FIG. 1 is very sensitive to even small differences in tension between the threads. Such differences result in severely distorted fabric. This may be a reason why the fabric of GB-A-1230232 does not appear to have been commercialised.

Figure 2:
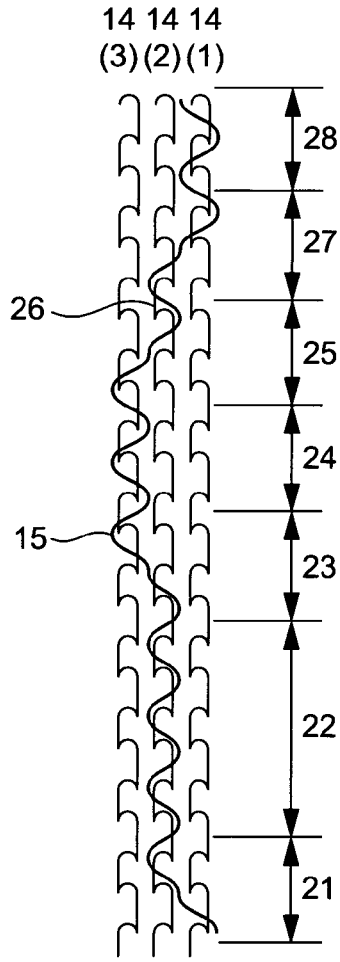
FIG. 2 illustrates the pattern of a single weft thread in a tulle according to the present invention.

The pattern of a single weft thread in a tulle according to the present invention is illustrated in FIG. 2. The pattern has a 24 course repeat, over the course of which the pillar stitches on the wales 14(1), 14(2), 14(3) are interconnected and tied-in. The weft thread 15 makes a complete three inlay cross-over 21 between the first 14(1) and second wale 14(2) and then makes six inlays 22 over six courses. Over the next three courses, the weft thread 15 crosses over in three inlays 23 to the third wale 14(3). The weft thread 15 makes four inlays 24 on the same wale 14(3) before crossing over with two inlays 25 back to the second wale 14(2). An inlay 26 is made on wale 14(2) then the weft thread 15 crosses-over with two inlays 27 to the first wale 14(1). The pattern is completed with four inlays 28 on the first wale 14(1).

Figure 3:
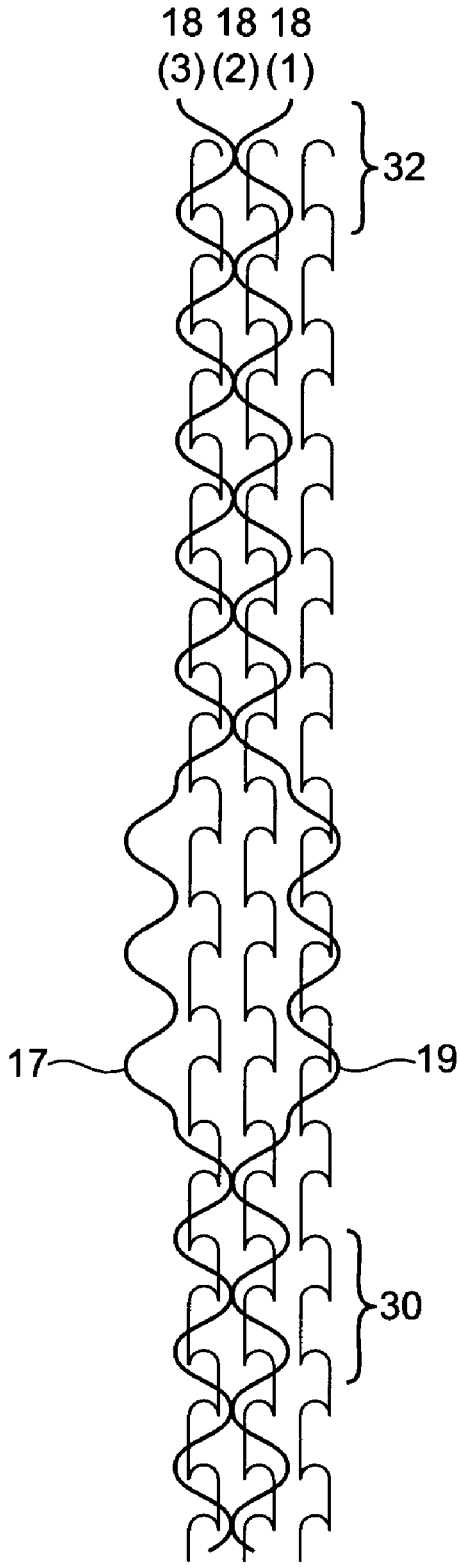
FIG. 3 illustrates the pattern of a pair of weft threads in a tulle according to the present invention.

The pattern of a pair of weft threads 17, 19 is illustrated in FIG. 3. The first weft thread 17 of the pair follows a pattern that is the inversion of the pattern as described in relation to FIG. 2; the plane of inversion being parallel to the courses and perpendicular to the wales. The second weft thread 19 of the pair follows a pattern that is a mirror image of the pattern followed by the first weft thread 17; the mirror plane being substantially parallel to the wales. Thus, the second weft thread 19 starts the pattern at the third wale 18(3) and inlays are lapped in the opposite direction to those of the first weft thread 17. The first 17 and second 19 weft threads cross at courses four to six, 30, and again at courses 22 and 24, 32. The pair of weft threads 17, 19 interconnects and ties-in four wales 18(1), 18(2), 18(3) and a fourth wale adjacent to 18(3) (the fourth wale not being shown in FIG. 3).

Figure 4:
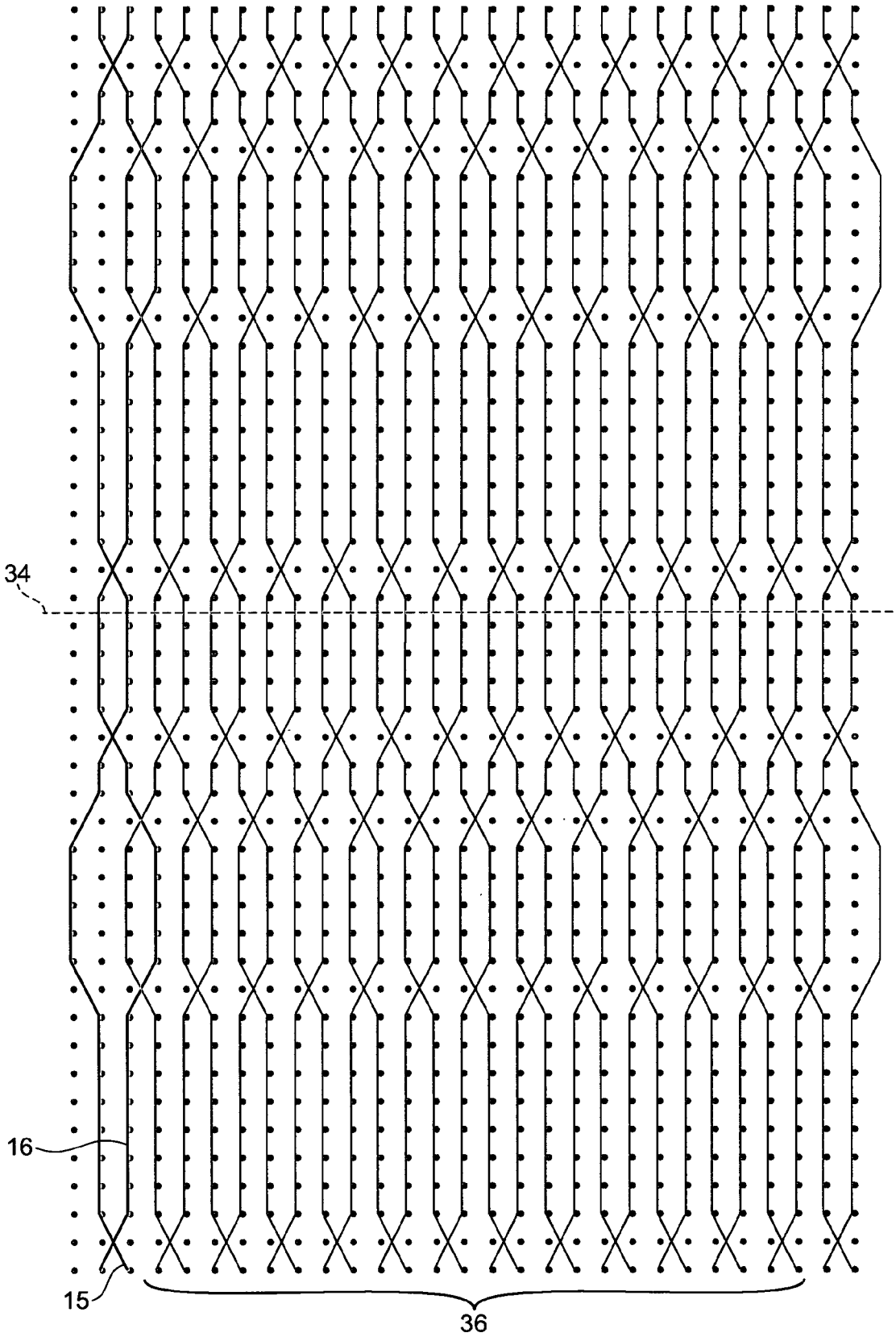
FIG. 4 illustrates schematically, the pattern of a plurality of first pairs of weft threads over a plurality of wales.

The pattern of a plurality of the first pairs of weft threads 15, 16 is illustrated in FIG. 4. Each pair of weft threads 15, 16 consists of a first weft thread 15 following the pattern described above and illustrated in FIG. 2, and a second weft thread 16 following the mirror image of that pattern. FIG. 4 illustrates the pattern formed by a plurality of pairs of weft threads 15, 16, and represents the pattern of half of the weft threads in an embodiment of a tulle according to the present invention. The pattern as illustrated over the line 36 repeats above the repeat line 34.

Figure 5:
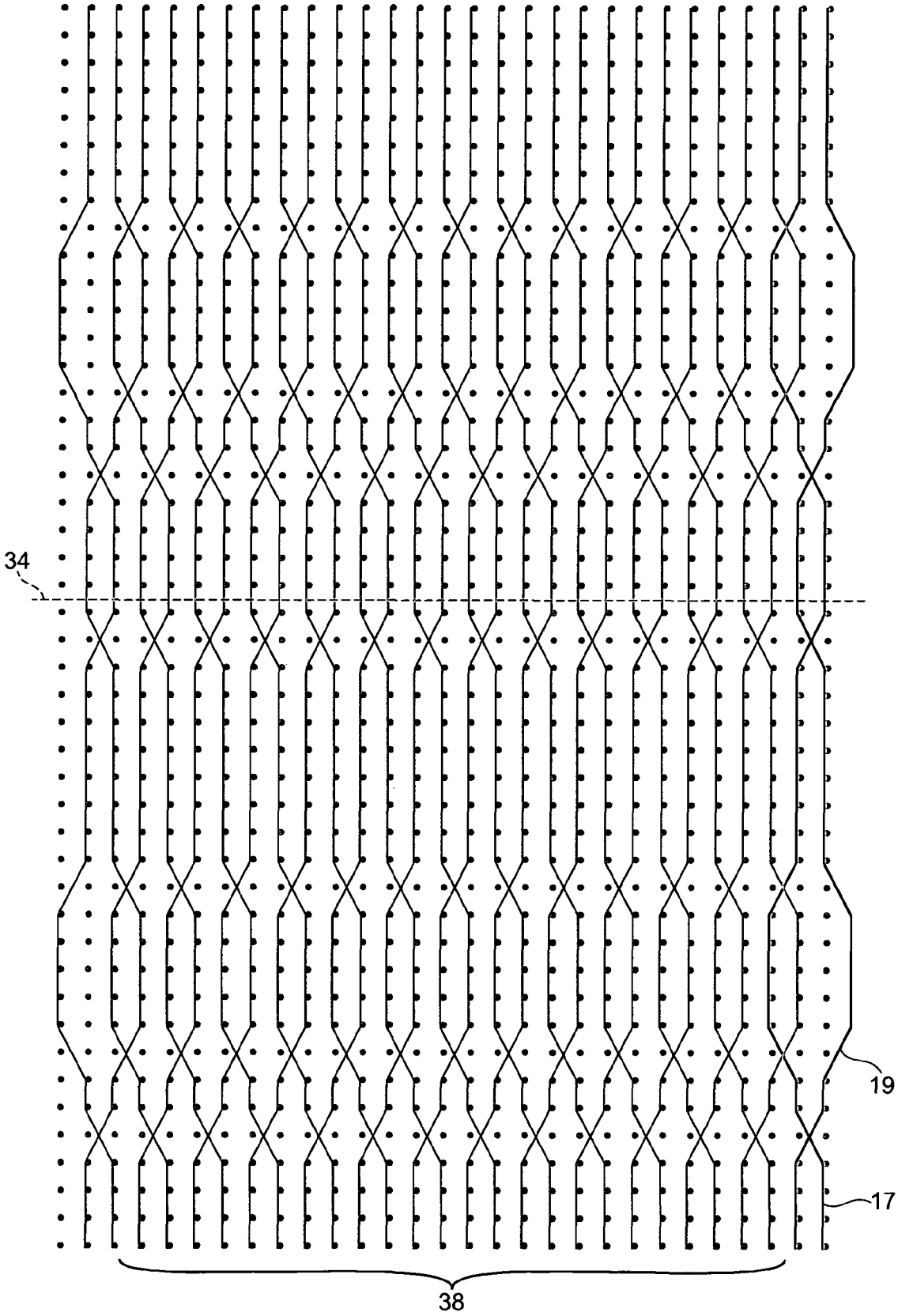
FIG. 5 illustrates, schematically, the pattern of a plurality of second pairs of threads over a plurality of wales.

The pattern of a plurality of the second pairs of weft threads 17, 19 is illustrated in FIG. 5. Each pair of weft threads 17, 19 follows the pattern described above and illustrated in FIG. 3. The pattern of the second pairs of weft threads 17, 19 is an inversion of the first pair of weft threads 15, 16 illustrated in FIG. 4 and represents the pattern of the other half of the weft threads in an embodiment of a tulle according to the present invention. The pattern as illustrated over the wales 38 repeats above the repeat line 34.

Figure 6:
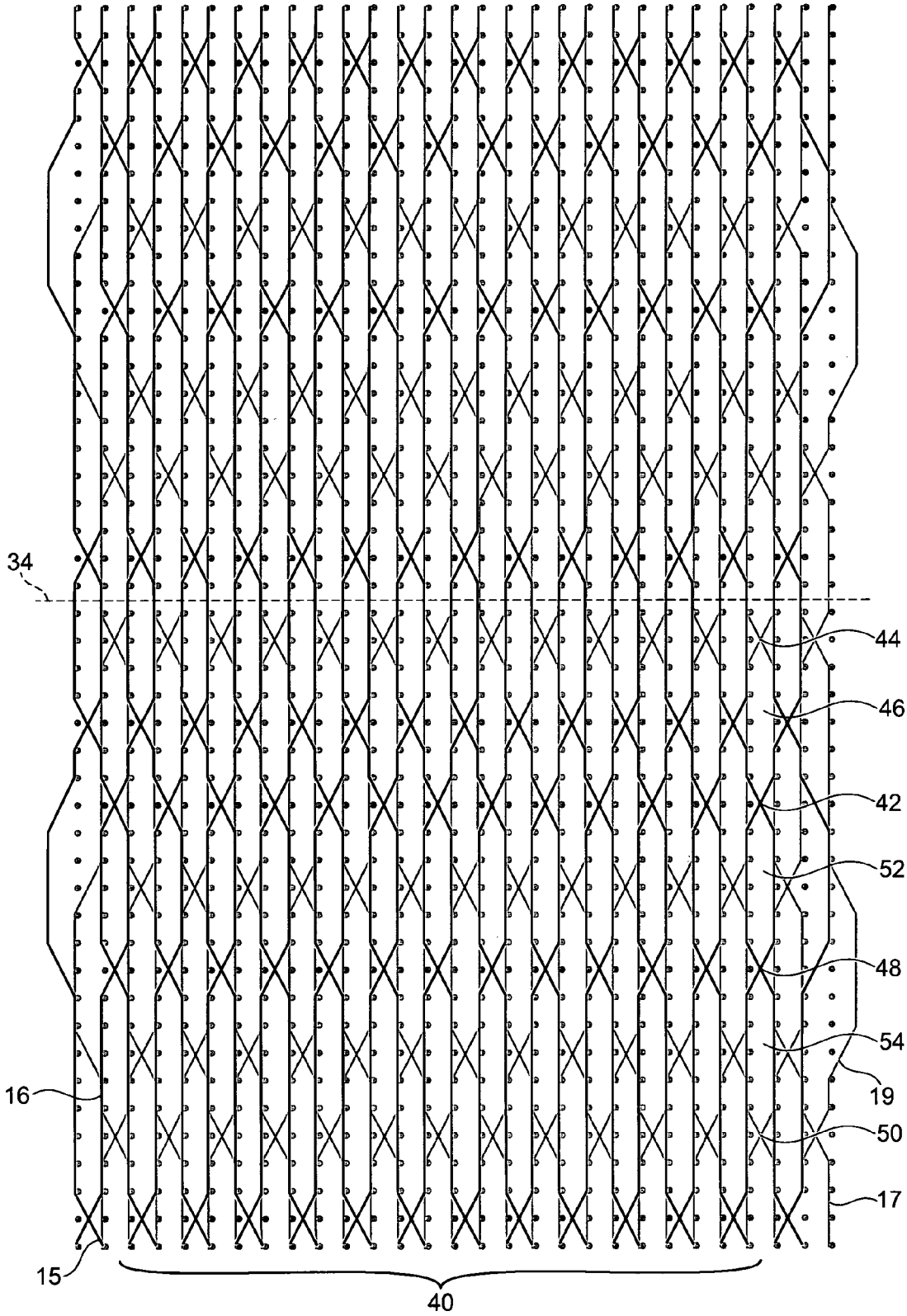
FIG. 6 illustrates, schematically, the pattern of the tulle of the present invention consisting of an overlay of the patterns illustrated in FIGS. 4 and 5.

The pattern of both the first and second pairs of weft threads 15, 16 and 17, 19 in a tulle according to an embodiment of the invention is illustrated in FIG. 6. The complete pattern as illustrated over the line 40 repeats above the repeat line 34. The complete pattern exhibits an array of substantially hexagonal holes 46, 52, 54 defined by the weft threads 15, 16 and 17, 19 between crosses in the weft threads 15 and 16 at 42 and 48 and crosses between the weft threads 17 and 19 at 44 and 50.

The tulle as illustrated in FIGS. 2 to 6 may be produced using a Raschel warp knitting machine having 5 or more guide bars. Guide bar 1 is used to define the wales with a pillar stitch with guide bars 2 to 5 used to define inlay weft threads, 17, 15, 16, 19 respectively as illustrated in FIGS. 2 to 6. Table 1, below, describes the guide bar movements for the weft threads for the interlacing of the otherwise unconnected wales.

As discussed above, the guide bar movements for guide bars 2 and 3 (corresponding to weft threads 17 and 15) and guide bars 4 and 5 (corresponding to weft threads 16 and 19) are an inversion of each other. Also, the movements of guide bars 3 and 4 (weft threads 15 and 16) and guide bars 2 and 5 (weft threads 17 and 19) follow patterns that are mirror images of each other.

A tulle according to the invention is much more forgiving of differences in tension between threads, the pattern appears to spread out differences in tension, resulting in a much more regular and strong tulle. The knitted tulle's flexibility and robustness provide a tulle which is directly comparable in its properties to bobbinet tulle.

TABLE 1

| Inlays | Bar 2 | Bar 3 | Bar 4 | Bar 5 |
|---|---|---|---|---|
| 1/ | 2 | 0 | 6 | 4 |
| 2/ | 0 | 2 | 4 | 6 |
| 3/ | 2 | 4 | 2 | 4 |
| 4/ | 0 | 2 | 4 | 6 |
| 5/ | 2 | 4 | 2 | 4 |
| 6/ | 4 | 2 | 4 | 2 |
| 7/ | 2 | 4 | 2 | 4 |
| 8/ | 4 | 2 | 4 | 2 |
| 9/ | 6 | 4 | 2 | 0 |
| 10/ | 4 | 2 | 4 | 2 |
| 11/ | 6 | 4 | 2 | 0 |
| 12/ | 4 | 6 | 0 | 2 |
| 13/ | 6 | 4 | 2 | 0 |
| 14/ | 4 | 6 | 0 | 2 |
| 15/ | 2 | 4 | 2 | 4 |
| 16/ | 4 | 6 | 0 | 2 |
| 17/ | 2 | 4 | 2 | 4 |
| 18/ | 4 | 2 | 4 | 2 |
| 19/ | 2 | 4 | 2 | 4 |
| 20/ | 4 | 2 | 4 | 2 |
| 21/ | 2 | 0 | 6 | 4 |
| 22/ | 4 | 2 | 4 | 2 |
| 23/ | 2 | 0 | 6 | 4 |
| 24/ | 0 | 2 | 4 | 6 |

The invention claimed is:

1. A knitted tulle comprising a plurality of wales each wale having a pillar stitch and at least two pairs of weft threads, wherein each pair of weft threads interconnects and ties-in at least four wales, each weft thread of each pair interconnects and ties-in at least three wales, and four or more weft threads inlay on each wale.

2. The tulle according to claim 1, wherein each weft thread of each pair follows a pattern which is the mirror-image of the other weft thread in the pair.

3. The tulle according to claim 1, wherein a first pair of weft threads which shares a wale with a second pair of weft threads, follows a pattern which is out-of-phase with the pattern of the second pair by a predetermined number of courses.

4. The tulle according to claim 3, wherein the repeat length of the pattern is a multiple of the predetermined number of courses.

5. The tulle according to claim 3, wherein the predetermined number of courses is a quarter of the repeat length.

6. The tulle according to claim 1, wherein a first pair of weft threads which shares a wale with a second pair of weft threads follows a pattern which is an inversion of the pattern of the second pair.

7. The tulle according to claim 1, wherein the pattern followed by each pair of weft threads has a repeat length of 12 to 60 courses.

8. The tulle as claimed in claim 1, wherein the pattern followed by each weft thread has a repeat of 24 courses.

9. The tulle as claimed in claim 7, wherein each weft thread of the first pair crosses to the corresponding wale of the other weft thread over three courses to form a first cross between the two wales, each weft thread of the pair then making six inlays in opposite directions on their respective wales, each weft thread of the pair then crossing over to a wale distal to the wale of the other weft thread in three courses over two wales, each weft thread then making three inlays in opposite directions in three courses, each weft thread then crossing over to its previously occupied wale in three inlays over three courses, crossing over to the corresponding wale of the other weft thread in three inlays over three courses to form a second cross between the two wales and each weft thread then making three inlays over three courses in opposite directions.

10. The tulle according to claim 9, wherein the second pair of weft threads follows a pattern which is the inverse of, and/or is out-of-phase by a predetermined number of courses with, the pattern followed by the first pair.

11. The tulle according to claim 1, wherein the tulle comprises a yarn selected from polyester, polyamide, polyaramid, cotton, wool, hemp, silk or a mixture of one or more of these yarns.

12. The tulle according to claim 1, wherein the yarn count is from 17 decitex to 280 decitex.

13. A method of knitting a tulle, the method comprising, forming a plurality of wales, and interconnecting at least some wales with at least two pairs of weft threads, wherein the method is such that each pair of weft threads interconnects and ties-in at least four wales, each weft thread of each pair interconnects and ties-in at least three wales, and four or more weft threads inlay on each wale.

14. The method according to claim 13, wherein the method of knitting is warp knitting.

15. The method according to claim 14, wherein the warp knitting is performed using a Raschel knitting machine.

16. The method according to claim 15, wherein the Raschel knitting machine has five or more guide bars.

17. The method according to claim 15, wherein the machine gauge is 20 needles per inch to 50 needles per inch.

18. A knitted tulle comprising a plurality of wales and a plurality of weft threads, wherein each weft threads interconnects and ties-in at least three wales, each weft thread of each pair interconnects and ties-in at least three wales, and four or more weft threads inlay on each wale.

19. The tulle according to claim 1, wherein the pattern followed by each pair of weft threads has a repeat length of 18 to 36 courses.

20. The tulle according to claim 1, wherein the pattern followed by each pair of weft threads has a repeat length of 20 to 30 courses.

* * * * *